United States Patent [19]

Bien

[11] Patent Number: 4,890,521

[45] Date of Patent: Jan. 2, 1990

[54] SELF-GRIPPING POWER SCREW DRIVER BIT

[75] Inventor: Alfred A. Bien, West Bloomfield, Mich.

[73] Assignee: Crysler Motors Corporation, Highland Park, Mich.

[21] Appl. No.: 352,534

[22] Filed: May 15, 1989

[51] Int. Cl.[4] ..... B25B 23/08

[52] U.S. Cl. ..... 81/448; 81/443

[58] Field of Search ..... 81/436, 438, 443, 448, 81/452

[56] References Cited

U.S. PATENT DOCUMENTS

| | | | |
|---|---|---|---|
| 791,548 | 6/1905 | Fischer . | |
| 1,647,343 | 11/1927 | Catron . | |
| 1,780,785 | 11/1930 | Jansson et al. . | |
| 2,445,383 | 7/1948 | Barlow . | |
| 2,576,454 | 11/1951 | Gearhart . | |
| 2,729,998 | 1/1956 | Deliso . | |
| 2,739,629 | 3/1956 | Neil . | |
| 2,775,913 | 1/1957 | Deliso | 81/448 |
| 2,890,733 | 6/1959 | Valiulis . | |
| 3,224,479 | 12/1965 | Osborn et al. | 81/443 |
| 3,831,648 | 8/1974 | Hill et al. | 81/448 |
| 3,900,057 | 8/1975 | Benitz | 81/443 |
| 4,078,593 | 3/1978 | Benitz | 81/443 |
| 4,338,835 | 7/1982 | Simons | 81/436 |

FOREIGN PATENT DOCUMENTS 1169277 6/1984 Canada .

*Primary Examiner*—James G. Smith

*Attorney, Agent, or Firm*—Edward P. Barthel

[57] ABSTRACT

A power driven screw driver self-gripping composite bit in the form of a pair of mirror image halved elements united at a common oblique interface providing a square end driver for reception in a screw head formed with a combined socket that accepts both a square end bit and a cross-point bit. Each halved element driver portion defines a trapezoidal cross section having major and minor parallel exterior side surfaces, a complete side surface extending at right angles to its major and minor surfaces, and a diagonal-like interface. The composite bit holder resiliently biases the halved elements interfaces into coextensive flush contact normally defining a square end driver. Upon threading torque being applied to the composite bit by a power screw driver the halved elements slip along their interfaces expanding the bit complete side surfaces in opposite directions so as to wedgingly engage their associated socket side faces into positive holding contact obviating slippage of the composite bit square end driver from the combined socket.

3 Claims, 1 Drawing Sheet

SELF-GRIPPING POWER SCREW DRIVER BIT

This invention relates generally to bits for screw drivers and more particularly to an expandable self-gripping screw holding bit for use with power-operated screw drivers.

BACKGROUND OF THE INVENTION

Various arrangements have heretofore been used for securing screws to screw driver bits. Examples of such arrangements are found in the U.S. Pat. Nos. 2,775,913 issued Jan. 1, 1957; and 2,729,998 issued Jan. 10, 1956 both to J. J. Deliso which disclose self-gripping tools having resilient shank portions sprung apart. The shank portions are insertable in the screw socket and expand to grip the interior walls of the socket whereby the screw is held releasably to the tool. The U.S. Pat. No. 1,647,343 issued Nov. 1, 1927 to B. J. Catron discloses a related tool with resilient prongs insertable in the kerf of a screw for removing or inserting the screw.

The U.S. Pat. No. 3,900,057 issued Aug. 19, 1975 to Benitz discloses an expandable bit screw holding screwdriver having a two piece longitudinally split shank which terminates at its forward ends in a dovetailed expandable bit. The bit comprises two driving tips wedge-shaped in cross section. The bit is expandable laterally by wedging together the tips using a forwardly movable sleeve encircling the shank.

The U.S. Pat. No. 4,078,596 issued Mar. 14, 1978 to E. Benitz discloses an expandable bit screw holding driver having a slide mechanism that is caused to rotate on a pair of shank elements. The slide moves the shank elements between their two positions which thicken and thin the screw driver blade. The U.S. Pat. No. 2,445,383 issued July 20, 1948 to G. W. Barlow discloses a screw driver having a two part expanding bit of the type shown by the Benitz patent.

The U.S. Pat. 2,739,629 issued Mar. 278, 1956 to J. M. Neil discloses a screw holding screw driver employing a bifurcated bit with a holding member rotatable therein.

The U.S. Pat. No. 4,338,835 issued July 13, 1982 to L. Simons discloses a fastener with ball-shaped socket receiving a complementary shaped driving head suitable for driving in a misaligned condition.

SUMMARY OF THE INVENTION

A primary object of the present invention is to provide a composite self-gripping square driver bit for a power operated screw driver for use with a screw having a combined driving recess, i.e. accepts either a bit having a square driver or a cross-point, Phillips head driver.

It is still another object of the present invention to provide a self-gripping bit as set forth above wherein the composite bit being composed of first and second mirror image halved wedge elements which are symmetrical with each other relative to a an axially extending oblique parting plane. The parting plane is defined by respective planar diagonal-like interfaces of the halved elements maintained in flush wedged contact. Each halved element driver end portion has a trapezoid cross section defined by major and minor parallel exterior side surfaces, a full exterior side surface oriented at right angles to the major and minor side surfaces, and an interior oblique wedging interface.

Initially, with no driving torque applied to the composite bit, the pair of halved elements cam wedge interfaces are biased into co-extensive flush relationship by resilient biasing means maintaining the square cross section driver. Upon the composite bit being inserted into a screw combined recess and a driving torque being applied to the halved elements the resilient biasing means is overcome and the element interfaces slip in a wedging manner. The operators applied force is thus multiplied causing the halved element full side surfaces to expand outwardly in opposed directions into flush locked engagement with associated oppositely facing exterior side walls of the screw recess preventing the composite bit from slipping or camming out of the screw recess. These and other objects and features of the invention will become apparent to those skilled in the vehicle suspension arts upon reading the following detailed description with reference to the accompanying drawings in which:

DESCRIPTION OF THE PREFERRED EMBODIMENT

Figure 1:
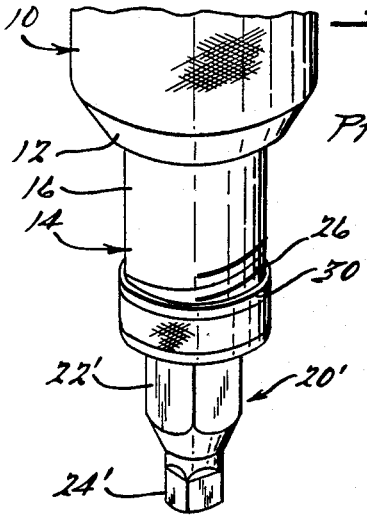
FIG. 1 is a fragmentary perspective view of a prior art square-end screw driver bit rotatably supported in a power driven screwdriver.
Figure 7:
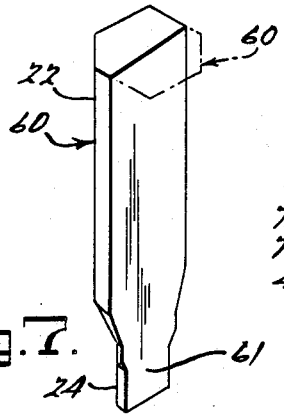
FIG. 7 is perspective view of one bit halved element of the present invention.

Referring now to FIG. 1 of the drawings, a power driven screw driver is partially shown at 10 having a bit inserted into the hole of a suitable chuck 12. The power driven screw driver could be an electric-operated tool such as disclosed, for example, in the U.S. Pat. No. 4,809,572 issued Mar. 7, 1989 to K. Sasaki. It will be noted that the screw driver 10 could be powered by other means such as by fluid or air, for example, without departing from the scope of the present invention.

The power driven screw driver 10 is provided with the chuck 12 for receiving a prior art screw driver bit holder indicated generally at 14. The holder 14 is in the form of an elongate cylindrical shaped metal rod 16 formed with an upper end (not shown) adapted to be engaged by conventional releasable locking means (not shown) in the power driven screw driver chuck 12.

Figure 5:
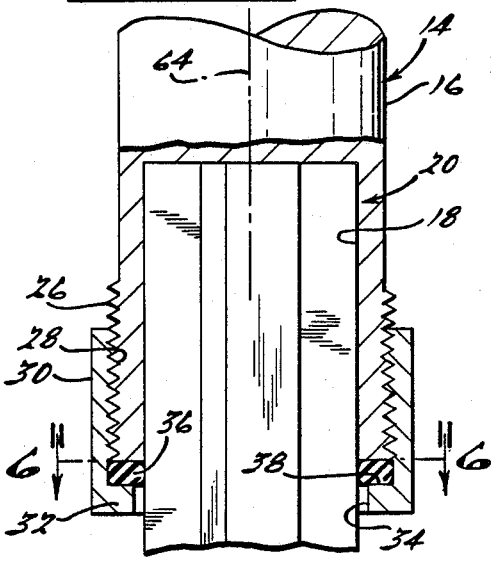
FIG. 5 is a fragmentary vertical sectional view taken on line 5—5 of FIG. 2.
Figure 6:
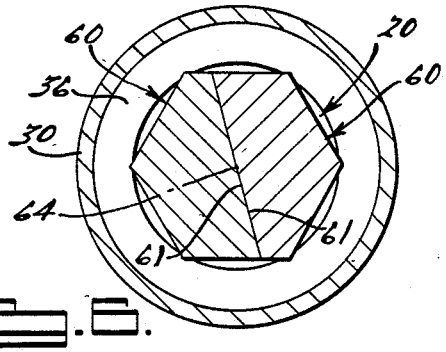
FIG. 6 is a horizontal sectional view taken on the line 6—6 of FIG. 5.

As seen in FIGS. 5 and 6, the holder rod 16 lower end is formed with a blind bore 18 having an internal hexagon-shaped cross section. It will be noted in prior art FIG. 1 the blind bore 18 is adapted to telescopically receive a prior art one-piece screw driver bit generally indicated at 20'. The bit 20' includes an upper stem portion 22' formed with an exterior hexagon-shaped cross section and a lower square-end driver 24' having a square cross section.

The rod 16 lower end has an external thread 26 threadably engaging internal thread 28 of a retaining nut or collar 30 having a knurled outer surface for hand tightening. The collar 30 has its lower end formed with an internal flange portion 32 defining a circular opening 34 of predetermined diameter. An O-ring 36, formed of suitable elastomeric material such as rubber, is sized to seat on inner ledge 38 of the flange portion 32. The O-ring 36 has a predetermined inner diameter for snugly telescopically receiving the bit hex-shaped stem portion 22' therein in an axially pressable manner.

Figure 2:
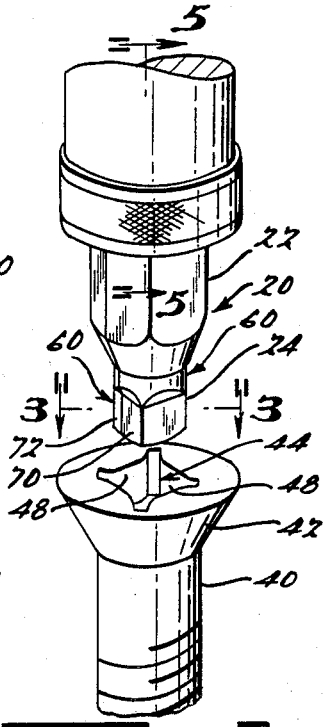
Fig. 2 is a fragmentary perspective view of the square-end screw driver composite bit of the present invention aligned for insertion in a screw having a combined driving recess.

With reference to FIG. 2 the self-gripping bit 20 of the present invention is shown aligned with a screw 40 having a head formed with a combined socket 44 of known design adapted to receive the square end of the bit. The combined socket 44 comprises a square recess 46 defined by four nearly vertical faces 48. The socket further has a cross-shaped recess defined by wings 50 emanating from the four corners of the square recess 44. The wings have side walls 52—52 and end walls 54. Thus, the combined socket 44 accepts both a square sectioned or square-end bit and a cross-point or Phillips bit.

The self-gripping composite bit 20 is composed of first and second mirror image halved bit elements 60—60 which are symmetrical with each other and united at an axially extending oblique plane common to element oblique interfaces 61—61. The interfaces 61—61 axially extending oblique common plane of symmetry for the composite bit is indicated by dashed construction line 62 in FIG. 3. It will be noted that the plane 62 includes the principal axis 64, shown in FIG. 5, as common to the rod 16 and the composite bit 20. The united pair of identical bit elements 60 comprise composite stem end portion 22 and driver end portion 24 corresponding to the prior art unitary bit portions 22' and 24'.

Figure 3:
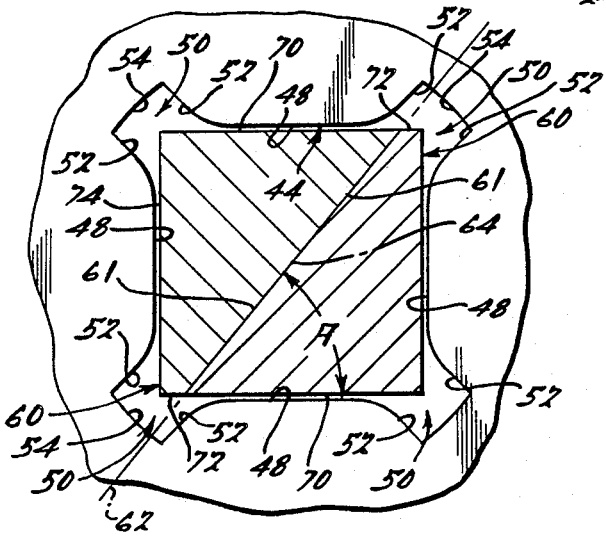
FIG. 3 is an enlarged horizontal fragmentary cross sectional view taken substantially on the line 3—3 of FIG. 2 with the square-end composite bit shown inserted in a screw combined driving socket prior to threading torque being delivered to the bit.

As seen in FIG. 3 each bit halved element 60 driver end portion 24 cross-section defines a trapezoid figure comprising, in part, major 70 and minor 72 parallel exterior side surfaces. Each element major side surface 70 is shown in FIG. 3 located in opposed spaced parallel relation with an associated square recess internal face 48. Each element minor side surface 72 is shown located in opposed spaced non-parallel relationship with an associated wing side wall 52. The trapezoid figure of each bit halved element 60 is further defined by a complete exterior side surface 74 located at right angles to its associated major 70 and minor 72 exterior side surfaces. Each complete side surface 74 is shown in FIG. 3 located in opposed parallel relationship with one associated square recess internal face 48. The trapezoid figure of each bit halved element 60 is completed by its oblique interface 61 located in flush coextensive relationship with its mirror image interface 61 of the remaining halved element 60.

Figure 4:
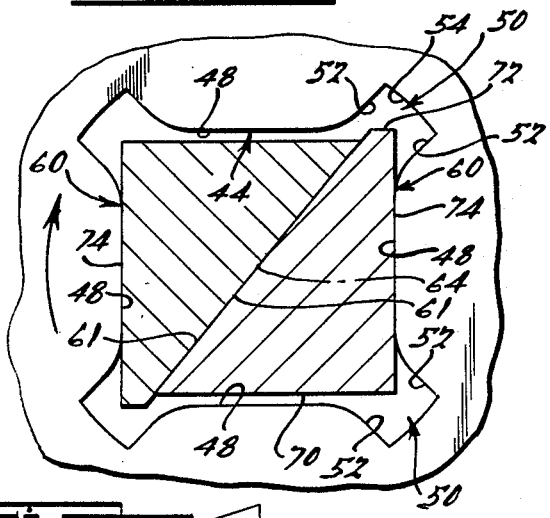
FIG. 4 is a view similar to FIG. 3 with threading torque applied to bit.

The composite bit 20 driver end portion 24 is shown in FIG. 3 symmetrically positioned in the combined socket 44 of the screw 40. Upon receiving a predetermined threading driving torque applied in a counter clockwise direction (arrow 80 in FIG. 4) from the power operated screw driver 10 the resultant force overcomes the resilient bias of the 0-ring 36. As a result, as seen in FIG. 4, the halved element interfaces 61 slip along their common plane of symmetry 62 such that the pair of complete side surfaces 74—74 expand and wedgingly engage their associated substantially parallel recess faces 48 locking the driver end portion 24 of the composite bit in the recess 44 in a self-aligned manner. In this manner the composite bit 20 of the present invention obviates "camout" or slippage of the square end driver halved elements 60—60 from the square recess 44. It will be appreciated that such slippage has been responsible for prior art bits striking and damaging part surfaces of work being secured by the screws 40 requiring repair or even replacement of such parts.

It will be noted in FIG. 4 that the combined socket 44 allows each element minor surface 72 to expand past its associated recess side face 48 by advancing into its associated cross-point wing 50. Further, the composite bit 20 maintains a symmetrical pattern within the combined socket. Thus, the principal axis 64 of the composite bit is maintained substantially coaxial with the principal axis of the power screw driver holder rod member 16.

In the disclosed embodiment each halved element major surface 70 defines an acute angle "A", shown in FIG. 3, of the order of 52 degrees with its associated interface 61.

While a preferred embodiment has been shown and described to illustrate the invention, other embodiments will become to those skilled in the art. Accordingly, the scope of his invention is set forth in the following claims.

What is claimed is:

1. A bit for a power-operated screw driver formed with a square cross section driver end and a shank end aligned on a central axis, said bit driver end portion for use with a screw having a combined socket that accepts the driver of either a square-sectioned bit or a cross-point bit, the socket having four substantially vertical faces that together define a square-sectioned recess, and having four wings disposed diagonally across the corners of the square, the wings being defined each by a pair of nearly vertical side walls, and an end wall, the wings defining a cross-slot recess, said screw driver provided with a cylindrical housing having a tubular open-ended cavity telescopically receiving one shank end of the bit, a collar having internal threads engaging external threads on said housing, means for preventing relative rotational movement between said bit shank and said housing cavity, biasing means operative to resiliently capture said shank end in said cavity such that said bit principal axis is aligned with the principal axis of said cavity, the improvement comprising:

a composite bit being composed of first and second mirror image halved elements which are symmetrical with each other relative to an axially extending oblique plane, each said halved element being formed with a driver portion having a trapezoid cross section, each said halved element driver portion having a trapezoid cross section defined by major and minor parallel exterior side surfaces, a complete exterior side surface oriented at right angles to said major and minor side surfaces, and an interior diagonal-like interface, said halved element interfaces in opposed flush contact defining said axially extending oblique plane which includes the principal axes of both said composite bit and the screw driver bit holder;

said biasing means normally resiliently urging the halved element driver portion interfaces into flush coextensive contact so as to define said square cross section driver end for reception in a screw combined socket such that each halved element complete side surface and each element major side surface is positioned in opposed spaced relation with an associated square recess face and each said halved element minor side surface positioned in opposed spaced relation with an associated wing side wall;

whereby upon said composite bit receiving a predetermined screw threading driving torque from the power operated screw driver overcoming said biasing means causing said halved element interfaces to slip along said common oblique plane such that the halved element complete side surfaces expand in opposite directions and wedgingly engage their associated opposed recess faces thereby positively holding said composite bit driver end portions in the screw combined socket obviating slippage of said composite bit driver end portions from the screw combined socket.

2. The improved composite bit as set forth in claim 1, wherein said halved elements minor side surface portions of a predetermined size such that they are free to advance radially outwardly past the imaginary plane of its associated recess face by virtue of being received in its associated cross-slot wing.

3. The improved two element bit as set forth in claim 1, wherein each halved element interface is oriented at an acute angle of the order of fifty degrees to the horizontal.

* * * * *